US009181826B2

(12) United States Patent
Sugiura et al.

(10) Patent No.: US 9,181,826 B2
(45) Date of Patent: Nov. 10, 2015

(54) VARIABLE VALVE MECHANISM OF INTERNAL COMBUSTION ENGINE

(71) Applicant: OTICS CORPORATION, Nishio-shi (JP)

(72) Inventors: Akira Sugiura, Nishio (JP); Koki Yamaguchi, Nishio (JP); Naoki Hiramatsu, Nishio (JP); Takayuki Maezako, Nishio (JP)

(73) Assignee: OTICS CORPORATION, Nishio-Shi, Aichi-Ken (JP)

( * ) Notice: Subject to any disclaimer, the term of this patent is extended or adjusted under 35 U.S.C. 154(b) by 0 days.

(21) Appl. No.: 14/066,562

(22) Filed: Oct. 29, 2013

(65) Prior Publication Data

US 2014/0137823 A1 May 22, 2014

(30) Foreign Application Priority Data

Nov. 20, 2012 (JP) ..... 2012-254619

(51) Int. Cl.
*F01L 1/34* (2006.01)
*F01L 13/00* (2006.01)

(52) U.S. Cl.
CPC ..... *F01L 13/0031* (2013.01); *F01L 13/0021* (2013.01); *F01L 13/0036* (2013.01)

(58) Field of Classification Search
USPC ..... 123/90.15–90.18
See application file for complete search history.

(56) References Cited

U.S. PATENT DOCUMENTS 4,768,475 A 9/1988 Ikemura
4,887,563 A * 12/1989 Ishida et al. ..... 123/90.16
5,429,079 A * 7/1995 Murata et al. ..... 123/90.16
6,202,610 B1 * 3/2001 Yoshiki et al. ..... 123/90.15
7,861,681 B2 1/2011 Manther et al.
2004/0099244 A1 * 5/2004 Matsuura et al. ..... 123/432
2004/0244748 A1 * 12/2004 Takahashi et al. ..... 123/90.18
2006/0236968 A1 10/2006 Falkowski et al.
2006/0254545 A1 11/2006 Hirano
2009/0178637 A1 7/2009 Gecim et al.

(Continued)

FOREIGN PATENT DOCUMENTS

DE 10 2008 007 255 A1 8/2008
EP 0 291 357 A1 11/1988
EP 0 600 221 A2 6/1994
EP 0 600 221 A3 6/1994

(Continued)

OTHER PUBLICATIONS

European Search Report dated Feb. 18, 2014.

*Primary Examiner* — Thomas Denion
*Assistant Examiner* — Daniel Bernstein
(74) *Attorney, Agent, or Firm* — McGinn IP Law Group, PLLC.

(57) ABSTRACT

The present invention provides a variable valve mechanism of an internal combustion engine which includes a main arm that is capable of swinging and that drives a valve when swinging, a first sub arm that is provided on one side in the lateral direction of the main arm and that swings when driven by a first cam, a second sub arm that is provided on the other side in the lateral direction of the main arm and that swings when driven by a second cam, and a switch device that performs switching between a first coupled state where only the first sub arm of the first and second sub arms is coupled to the main arm, and a second coupled state where only the second sub arm of the first and second sub arms is coupled to the main arm.

10 Claims, 10 Drawing Sheets

(56) References Cited

U.S. PATENT DOCUMENTS

| | | | | |
|---|---|---|---|---|
| 2010/0307434 | A1* | 12/2010 | Odell et al. | 123/90.15 |
| 2011/0132302 | A1* | 6/2011 | Hayashi et al. | 123/90.16 |

FOREIGN PATENT DOCUMENTS

| | | | |
|---|---|---|---|
| GB | 2470025 | A | 11/2010 |
| JP | 2010-031788 | A | 2/2010 |

* cited by examiner

VARIABLE VALVE MECHANISM OF INTERNAL COMBUSTION ENGINE

TECHNICAL FIELD

The present invention relates to variable valve mechanisms that switch the drive state of valves according to the operating condition of an internal combustion engine.

BACKGROUND ART

There is a variable valve mechanism 90 of a first conventional example shown in FIGS. 9 and 10 among the variable valve mechanisms. This variable valve mechanism 90 includes a central main arm 97 that contacts a central low lift cam 92 and that drives valves when swinging, a left sub arm 98 that contacts a left medium lift cam 93, and a right sub arm 99 that contacts a right high lift cam 94. A low lift state where the main arm 97 swings according to the cam profile of the low lift cam 92 is achieved by coupling neither the left sub arm 98 nor the right sub arm 99 to the central main arm 97. A medium lift state where the main arm 97 swings according to the cam profile of the medium lift cam 93 is achieved by coupling only the left sub arm 98 to the central main arm 97. A high lift state where the main arm 97 swings according to the cam profile of the high lift cam 94 is achieved by coupling both the left and right sub arms 98, 99 to the central main arm 97.

CITATION LIST

Patent Document

[Patent Document 1] Japanese Patent Application Publication No. 2010-31788 (JP 2010-31788 A)

SUMMARY OF INVENTION

Technical Problem

In such a three-stage variable valve mechanism 90, the inventors of the present invention desired to increase the lift amount and decrease the working angle when in the medium lift state in order to achieve high performance, and desired to suppress the lift amount and increase the working angle when in the high lift state in order to achieve higher fuel efficiency (Atkinson cycle etc.).

In the variable valve mechanism 90, however, both left and right sub arms 98, 99 are coupled to the central main arm 97 when in the high lift state. The main arm 97 therefore swings according to the cam profile of one of the medium and high lift cams 93, 94 which has a larger lift amount. Accordingly, as shown by solid lines in FIG. 10, a high lift curve c2 showing the lift amount of the high lift cam 94 is required to constantly exceed a medium lift curve c1 showing the lift amount of the medium lift cam 93, and the high lift curve c2 cannot be lowered to cross the medium lift curve c1 as shown by a two-dot chain line in FIG. 10. The variable valve mechanism 90 therefore cannot meet the need to suppress the lift amount in the high lift state, and fuel efficiency in the high lift state decreases.

It is an object of the present invention to increase design flexibility of cam profiles by allowing two lift curves such as medium and high lift curves to cross.

Solution to Problem

In order to achieve the above object, a variable valve mechanism of an internal combustion engine of the present invention includes: a main arm that is capable of swinging and that drives a valve when swinging; a first sub arm that is provided on one side in the lateral direction of the main arm and that swings when driven by a first cam provided on a camshaft so as to protrude from the camshaft; a second sub arm that is provided on the other side in the lateral direction of the main arm and that swings when driven by a second cam provided on the camshaft so as to protrude from the camshaft; and a switch device that performs switching between a first coupled state where only the first sub arm of the first and second sub arms is coupled to the main arm so as to be non-swingable relative to the main arm and the main arm thus swings according to a cam profile of the first cam, and a second coupled state where only the second sub arm of the first and second sub arms is coupled to the main arm so as to be non-swingable relative to the main arm and the main arm thus swings according to a cam profile of the second cam.

According to this configuration, a first lift curve showing a lift amount of the valve relative to a rotation angle of the cam shaft when in the first coupled state can be made to cross a second lift curve showing the lift amount of the valve relative to the rotation angle of the cam shaft when in the second coupled state. This can increase design flexibility of the cam profiles of the first and second cams. Preferably, the first lift curve and the second lift curve cross each other, although the present invention is not particularly limited to this.

The form of the switch device is not particularly limited. However, it is preferable that the switch device include a first coupling pin that extends across a boundary between the main arm and the first sub arm when in the first coupled state and that does not extend across the boundary between the main arm and the first sub arm when in the second coupled state, and a second coupling pin that extends across a boundary between the main arm and the second sub arm when in the second coupled state and that does not extend across the boundary between the main arm and the second sub arm when in the first coupled state.

The switch device may perform switching only between the first coupled state and the second coupled state. However, it is preferable that the switch device perform switching among a non-coupled state where neither the first sub arm nor the second sub arm is coupled to the main arm so as to be non-swingable relative to the main arm, the first coupled state, and the second coupled state, because the switching can be performed in three stages. The following forms [i] and [ii] are shown as examples in the non-coupled state.

[i] A form in which the cam shaft is provided with a third cam having a smaller lift amount than the first and second cams, and when in the non-coupled state, the main arm swings according to a cam profile of the third cam.

[ii] A form in which when in the non-coupled state, the main arm does not swing at all and rests.

The form of the switch device in the case of such three-stage switching is not particularly limited. However, it is preferable that the switch device include a first coupling pin that extends across a boundary between the main arm and the first sub arm when in the first coupled state and that does not extend across the boundary between the main arm and the first sub arm when in the non-coupled state and the second coupled state, and a second coupling pin that extends across a boundary between the main arm and the second sub arm when in the second coupled state and that does not extend across the boundary between the main arm and the second sub arm when in the non-coupled state and the first coupled state.

More specifically, it is preferable that the switch device include: a first interposed pin that is provided in the main arm so as to contact the first coupling pin; a second interposed pin that is provided in the main arm so as to contact the second coupling pin; a non-coupling hydraulic mechanism that is provided in the main arm and that uses an oil pressure to press the first coupling pin into the first sub arm via the first interposed pin and to press the second coupling pin into the second sub arm via the second interposed pin when in the non-coupled state; a return spring that is provided in the first sub arm and that uses a restoring force to press the first coupling pin to a position where the first coupling pin extends across a boundary between the first sub arm and the main arm and to press the second coupling pin into the second sub arm via the first coupling pin, the first interposed pin, and the second interposed pin, when in the first coupled state; and a coupling hydraulic mechanism that is provided in the second sub arm, and that uses an oil pressure to press the second coupling pin to a position where the second coupling pin extends across a boundary between the second sub arm and the main arm and to press the first coupling pin into the first sub arm via the second coupling pin, the second interposed pin, and the first interposed pin, when in the second coupled state. This configuration allows one common switch device to be used in the three-stage switching structure, whereby compact, light arms can be achieved.

Advantageous Effects of Invention

According to the present invention, the first lift curve showing the lift amount of the valve relative to the rotation angle of the cam shaft when in the first coupled state can be made to cross the second lift curve showing the lift amount of the valve relative to the rotation angle of the cam shaft when in the second coupled state. This can increase design flexibility of the cam profiles of the first and second cams, thereby facilitating optimal cam profile design. For example, high performance can be ensured during low to medium speed rotation, and fuel efficiency can be improved during high speed rotation.

BRIEF DESCRIPTION OF DRAWINGS

(FIG. 4A is a sectional view taken along line IVa-IVa in FIG. 3, and FIG. 4B is a sectional view taken along line IVb-IVb in FIG. 3);

DESCRIPTION OF EMBODIMENTS

Figure 1:
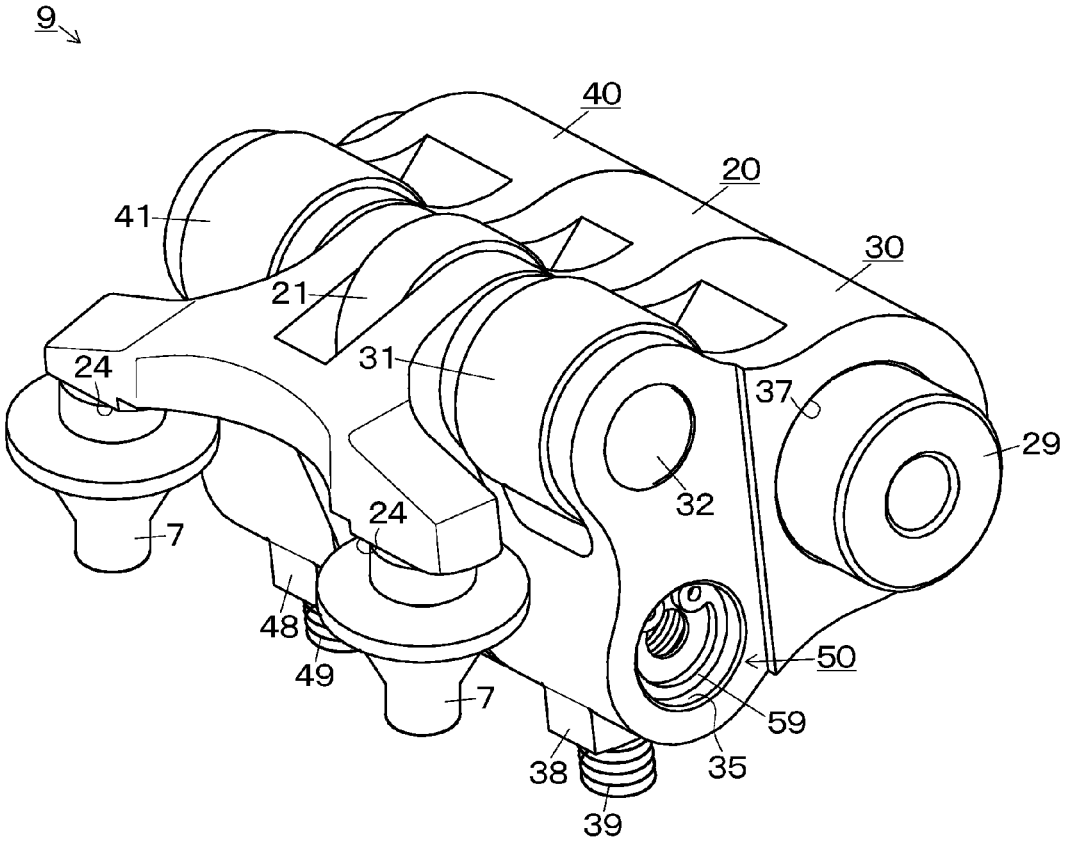
FIG. 1 is a perspective view showing a variable valve mechanism of an embodiment.
Figure 2:
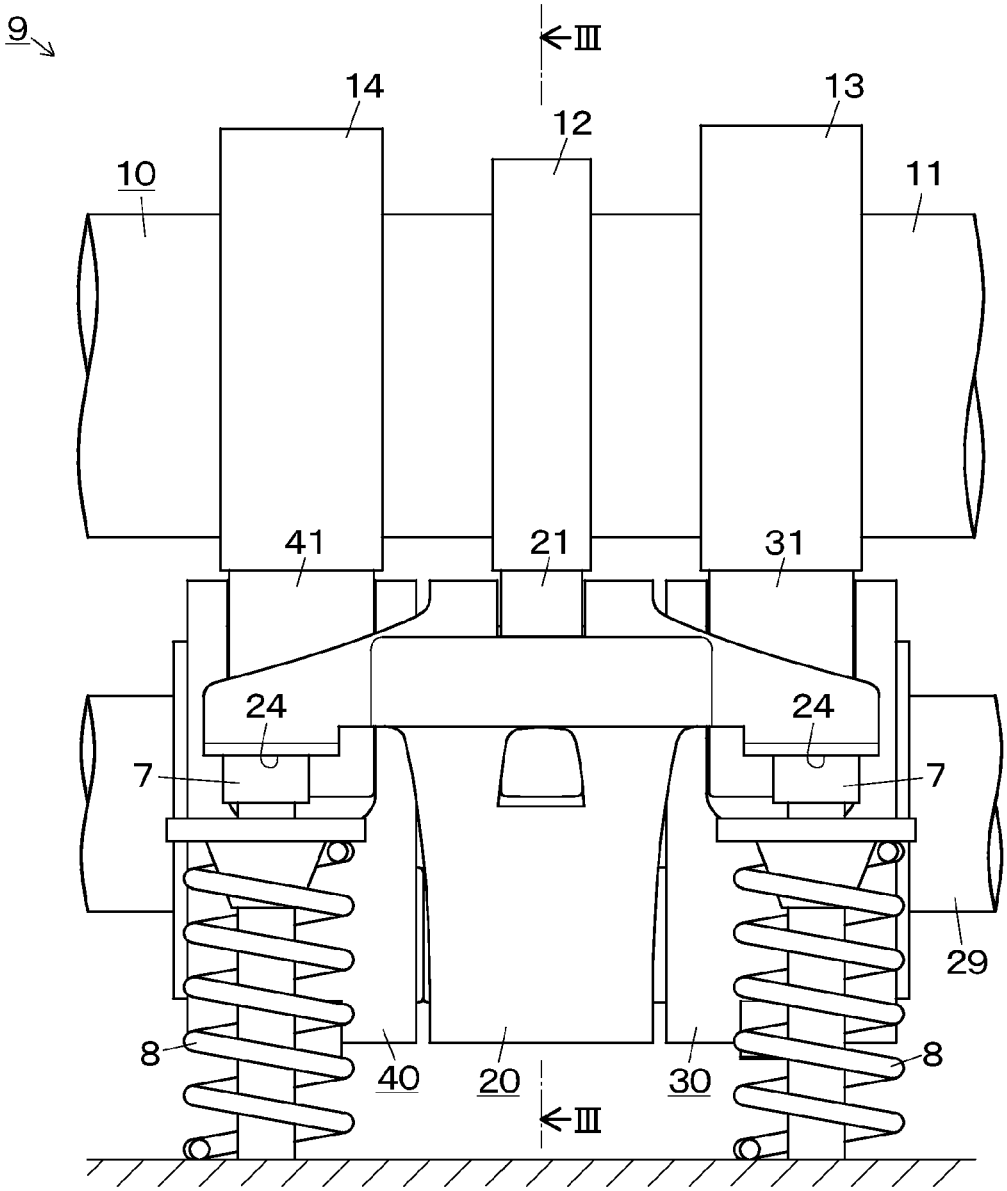
FIG. 2 is a front view showing the variable valve mechanism of the embodiment.
Figure 3:
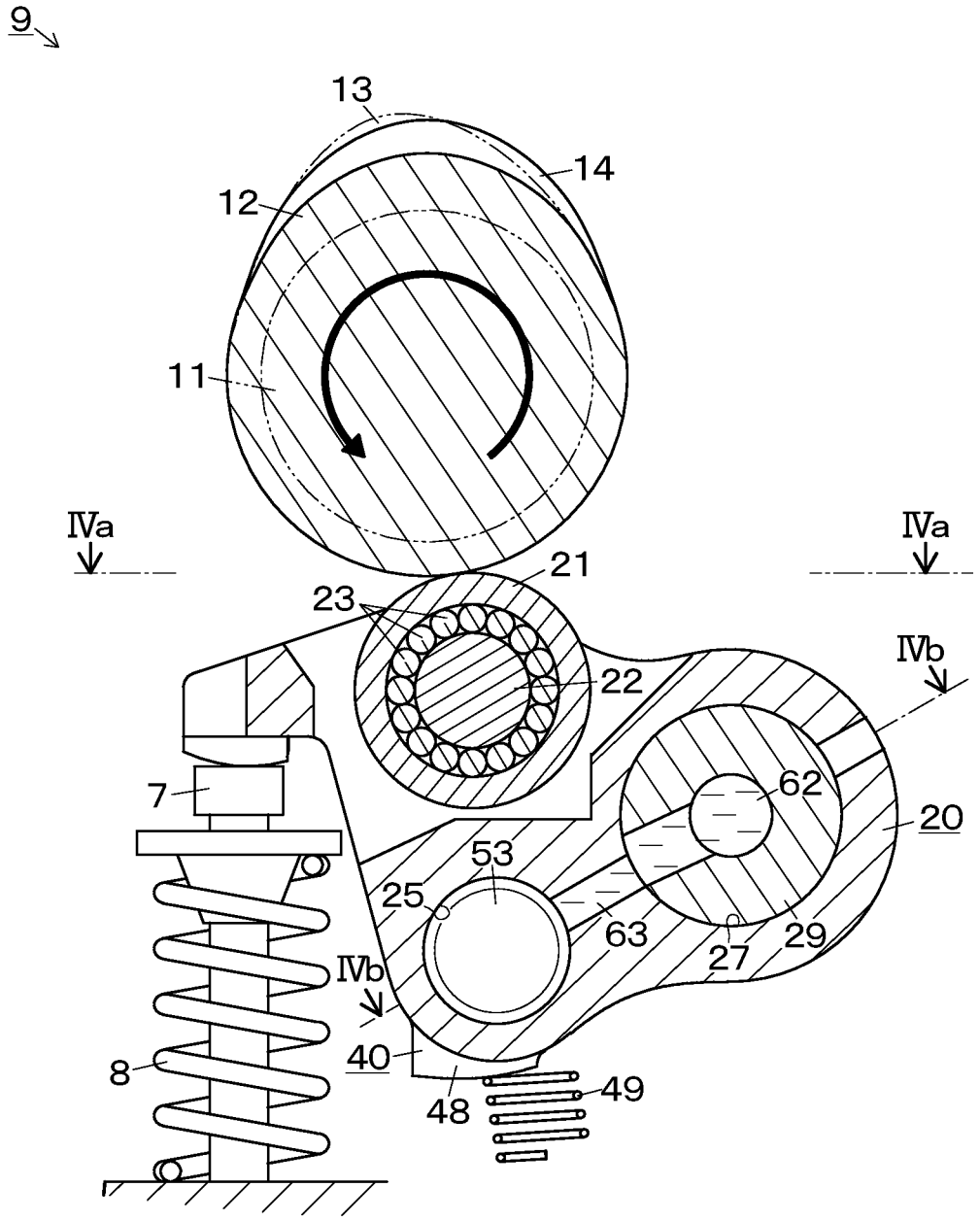
FIG. 3 is a side sectional view showing the variable valve mechanism of the embodiment.
Figure 4A:
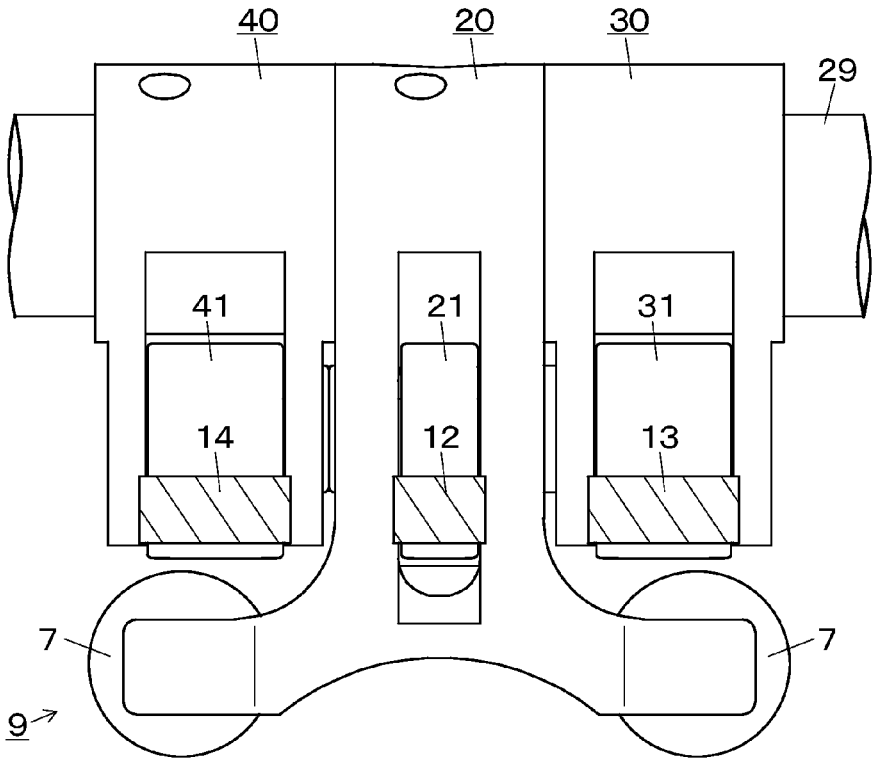
FIGS. 4A and 4B are planar sectional views showing the variable valve mechanism of the embodiment
Figure 4B:
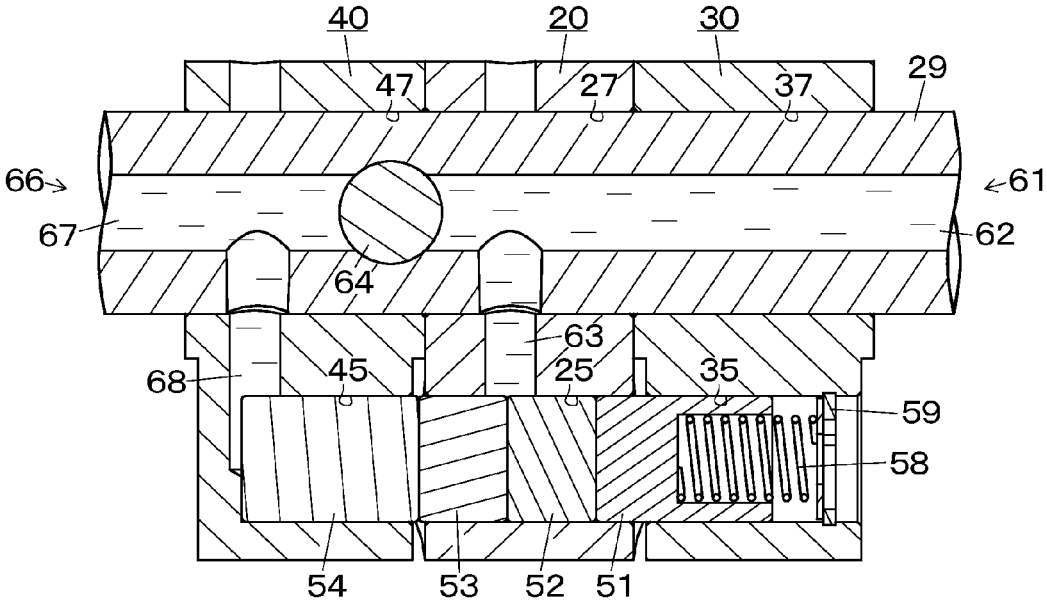

A variable valve mechanism 9 of an embodiment shown in FIGS. 1 to 8 is a mechanism that opens and closes valves 7, 7 of an internal combustion engine having valve springs 8, 8 respectively attached thereto, by pressing down the valves 7, 7. The variable valve mechanism 9 includes a drive unit 10, a main arm 20, a first sub arm 30, a second sub arm 40, and a switch device 50, which will be described below. In the following description, "right" refers to one side of the lateral direction of the main arm 20, and "left" refers to the other side thereof. However, "left" and "right" may be reversed.

[Drive Unit 10]

Figure 8:
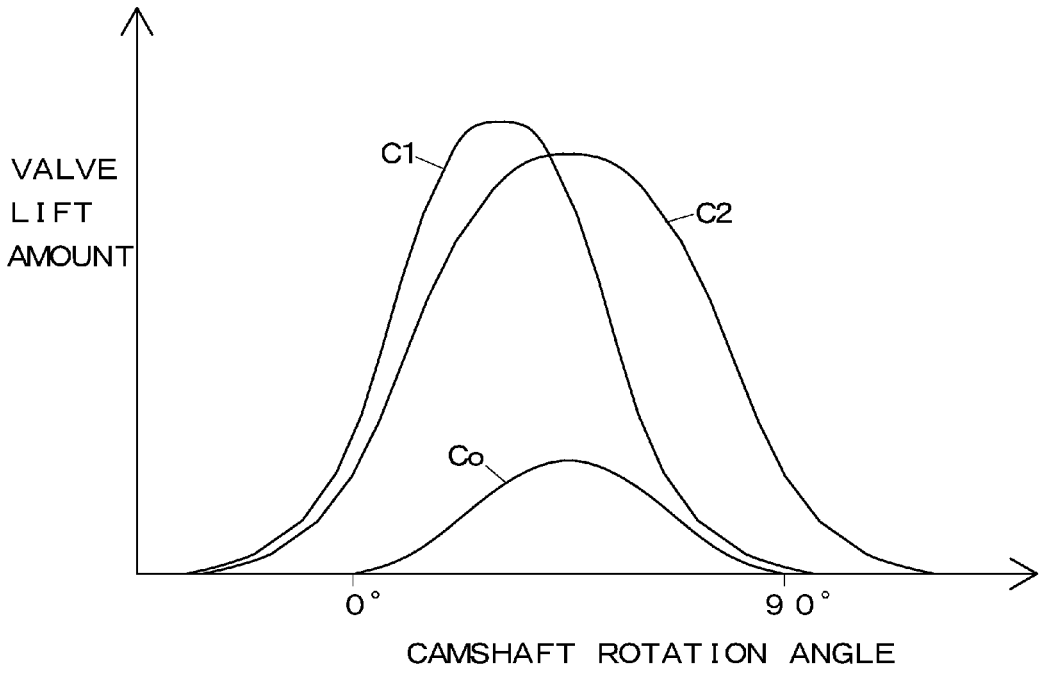
FIG. 8 is a graph showing the valve lift amount relative to the camshaft rotation angle of the variable valve mechanism of the embodiment.
Figure 9:
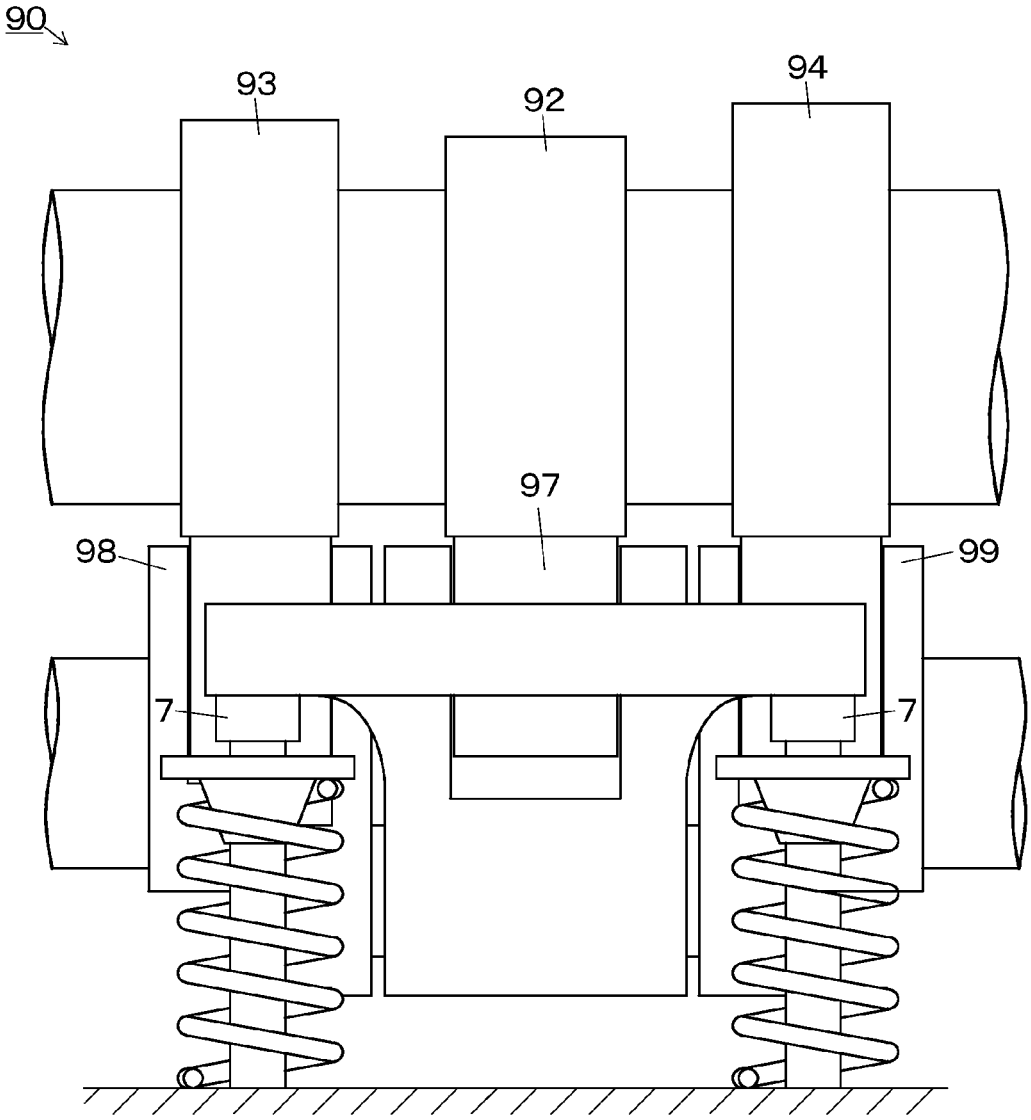
FIG. 9 RELATED ART
FIG. 9 is a front view showing a variable valve mechanism of a conventional example.
Figure 10:
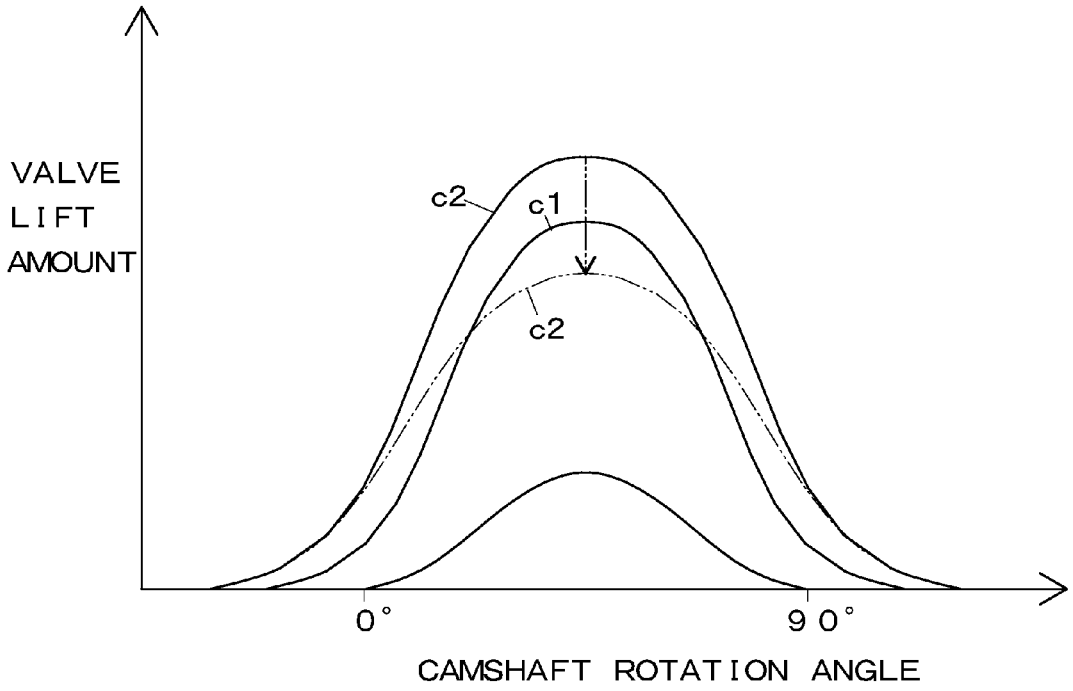
FIG. 10 RELATED ART
FIG. 10 is a graph showing the valve lift amount relative to the camshaft rotation angle of the variable valve mechanism of the conventional example.

The drive unit 10 is formed by a camshaft 11 extending in the lateral direction and rotating according to rotation of the internal combustion engine, a low lift cam 12 provided on the camshaft 11 so as to protrude therefrom, a medium lift cam 13 provided on the camshaft 11 at a position on the right side of the low lift cam 12 so as to protrude from the camshaft 11, and a high lift cam 14 provided on the camshaft 11 at a position on the left side of the low lift cam 12 so as to protrude from the camshaft 11. In FIG. 8, a medium lift curve C1 shows the lift amount of the valve 7 relative to the rotation angle of the camshaft 11 according to the cam profile of the medium lift cam 13, a high lift curve C2 shows the lift amount of the valve 7 relative to the rotation angle of the camshaft 11 according to the cam profile of the high lift cam 14, and a low lift curve Co shows the lift amount of the valve 7 relative to the rotation angle of the camshaft 11 according to the cam profile of the low lift cam 12. As shown in FIG. 8, the medium lift curve C1 crosses the high lift curve C2. Specifically, the working angle in the medium lift curve C1 is narrower than that in the high lift curve C2, but the maximum lift amount in the medium lift curve C1 is higher than that in the high lift curve C2. Meanwhile, the working angle in the high lift curve C2 is wider than that in the medium lift curve C1, but the maximum lift amount in the high lift curve C2 is lower than that in the medium lift curve C1. The lift amount in the medium lift curve C1 reaches its maximum value earlier than that in the high lift curve C2. The entire low lift curve Co is located inside the medium lift curve C1 and the high lift curve C2.

[Main Arm 20]

The main arm 20 is an arm extending in the longitudinal direction, and has in its rear end portion a shaft hole 27 extending therethrough in the lateral direction. A rocker shaft 29 extending in the lateral direction is inserted through the shaft hole 27, whereby the rear end portion is supported so as to be swingable about the shaft. The tip end portion of the main arm 20 is widened in the lateral direction, and pressing portions 24, 24 that press the valves 7, 7 are provided on the lower surface of the right and left ends of the tip end portion. When swinging, the main arm 20 drives the valves 7, 7 by pressing down the valves 7, 7 with the pressing portions 24, 24. A roller 21 contacting the low lift cam 12 is rotatably supported in the upper part of an intermediate portion in the longitudinal direction of the main arm 20 via a roller shaft 22 and bearings 23. A pin hole 25 is formed in the lower part of the intermediate portion in the longitudinal direction of the main arm 20 so as to extend therethrough in the lateral direction.

[First Sub Arm 30]

The first sub arm 30 is an arm provided on the right side of the main arm 20 and extending in the longitudinal direction, and has in its rear end portion a shaft hole 37 extending therethrough in the lateral direction. The rocker shaft 29 is inserted through the shaft hole 37, whereby the rear end portion is supported so as to be swingable about the shaft. A roller 31 contacting the medium lift cam 13 is rotatably supported in the upper part of the front end portion of the first sub arm 30 via a roller shaft 32 and bearings (not shown). A pin hole 35 is formed in the lower part of the front end portion of the first sub arm 30 so as to extend therethrough in the lateral direction. A lost motion protrusion 38 contacting a lost motion spring 39 is provided on the lower surface of the front end portion of the first sub arm 30.

[Second Sub Arm 40]

The second sub arm 40 is an arm provided on the left side of the main arm 20 and extending in the longitudinal direction, and has in its rear end portion a shaft hole 47 extending therethrough in the lateral direction. The rocker shaft 29 is inserted through the shaft hole 47, whereby the rear end portion is supported so as to be swingable about the shaft. A roller 41 contacting the high lift cam 14 is rotatably supported in the upper part of the tip end portion of the second sub arm 40 via a roller shaft (not shown) and bearings (not shown). A pin hole 45 that opens to the right is formed in the lower part of the front end portion of the second sub arm 40. A lost motion protrusion 48 contacting a lost motion spring 49 is provided on the lower surface of the front end portion of the second sub arm 40.

[Switch Device 50]

The switch device 50 is a device that switches the lift state among a low lift state (non-coupled state), a medium lift state (first coupled state), and a high lift state (second coupled state). The low lift state (non-coupled state) is a state where neither the first sub arm 30 nor the second sub arm 40 is coupled to the main arm 20 so as to be non-swingable relative to the main arm 20. The medium lift state (first coupled state) is a state where only the first sub arm 30 of the first and second sub arms 30, 40 is coupled to the main arm 20 so as to be non-swingable relative to the main arm 20 and the second sub arm 40 is not coupled to the main arm 20 so as to be non-swingable relative to the main arm 20. The high lift state (second coupled state) is a state where only the second sub arm 40 of the first and second sub arms 30, 40 is coupled to the main arm 20 so as to be non-swingable relative to the main arm 20 and the first sub arm 30 is not coupled to the main arm 20 so as to be non-swingable relative to the main arm 20. This switch device 50 includes a first coupling pin 51, a second coupling pin 54, a first interposed pin 52, a second interposed pin 53, a return spring 58, a non-coupling hydraulic mechanism 61, and a coupling hydraulic mechanism 66, which will be described below.

The first coupling pin 51 is inserted in the pin hole 35 of the first sub arm 30. In the medium lift state, the first coupling pin 51 is advanced out of the pin hole 35 of the first sub arm 30 to the left and extends across the boundary between the pin hole 35 and the pin hole 25 of the main arm 20. In the low lift state and the high lift state, the first coupling pin 51 is withdrawn into the pin hole 35 of the first sub arm 30 and does not extend across the boundary between the pin hole 35 and the pin hole 25 of the main arm 20. The second coupling pin 54 is inserted in the pin hole 45 of the second sub arm 40. In the high lift state, the second coupling pin 54 is advanced out of the pin hole 45 of the second sub arm 40 to the right and extends across the boundary between the pin hole 45 and the pin hole 25 of the main arm 20. In the low lift state and the medium lift state, the second coupling pin 54 is withdrawn into the pin hole 45 of the second sub arm 40 and does not extend across the boundary between the pin hole 45 and the pin hole 25 of the main arm 20.

The first interposed pin 52 is inserted in the right part of the pin hole 25 of the main arm 20. The right end face of the first interposed pin 52 is in contact with the left end face of the first coupling pin 51. The second interposed pin 53 is inserted in the left part of the pin hole 25 of the main arm 20. The left end face of the second interposed pin 53 is in contact with the right end face of the second coupling pin 54. The return spring 58 is a spring interposed between the left side surface of a retainer 59 attached to the right opening of the pin hole 35 of the first sub arm 30 and the right end face of the first coupling pin 51.

The non-coupling hydraulic mechanism 61 is a mechanism that changes the oil pressure in the pin hole 25 of the main arm 20. The non-coupling hydraulic mechanism 61 is formed by a non-coupling shaft oil passage 62 formed in the right part of the rocker shaft 29, a non-coupling arm oil passage 63 formed in the main arm 20 to supply the oil pressure in the non-coupling shaft oil passage 62 to the region between the first interposed pin 52 and the second interposed pin 53 in the pin hole 25, and a non-coupling hydraulic device (not shown) that supplies an oil pressure to the non-coupling shaft oil passage 62. The coupling hydraulic mechanism 66 is a mechanism that changes, the oil pressure in the pin hole 45 of the second sub arm 40. The coupling hydraulic mechanism 66 is formed by a coupling shaft oil passage 67 formed in the left part of the rocker shaft 29, a coupling arm oil passage 68 formed in the second sub arm 40 to supply the oil pressure in the coupling shaft oil passage 67 to the region between the inner bottom surface of the pin hole 45 and the second coupling pin 54 in the pin hole 45 of the second sub arm 40, and a coupling hydraulic device (not shown) that supplies an oil pressure to the coupling shaft oil passage 67. The non-coupling shaft oil passage 62 on the right side is separated from the coupling shaft oil passage 67 on the left side by a partition pin 64 inserted in the rocker shaft 29.

Switching of the drive state of the valves 7, 7 by the variable valve mechanism 9 will be described below with respect to the case of [1] the low lift state, [2] the medium lift state, and [3] the high lift state.

[1] In the Low Lift State (Non-Coupled State)

Figure 5A:
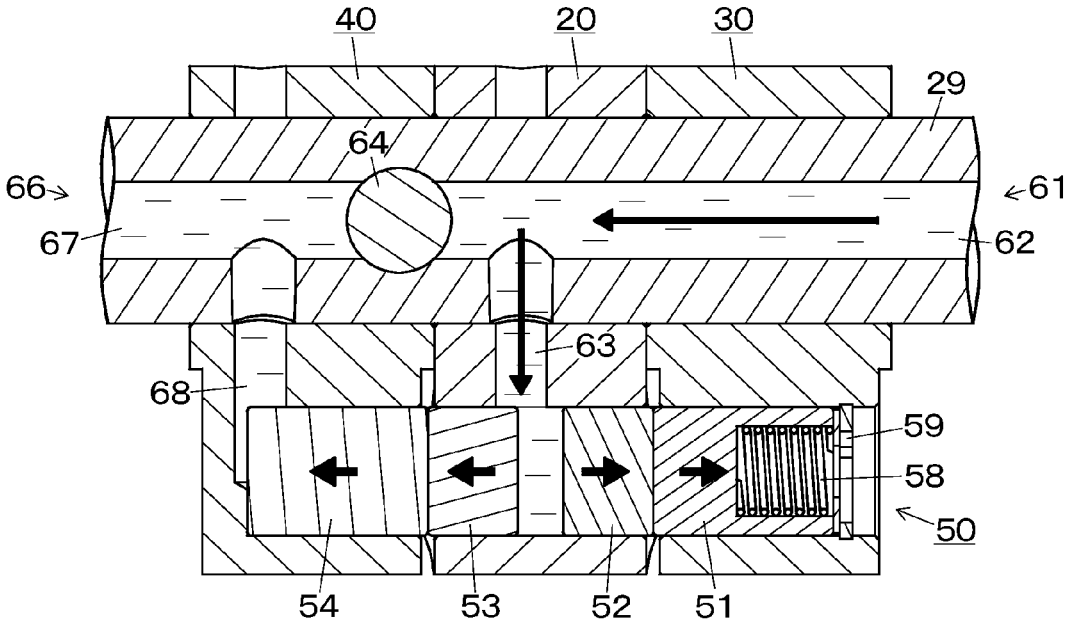
FIG. 5A is a planar sectional view showing the variable valve mechanism of the embodiment in a low lift state.
Figure 5B:
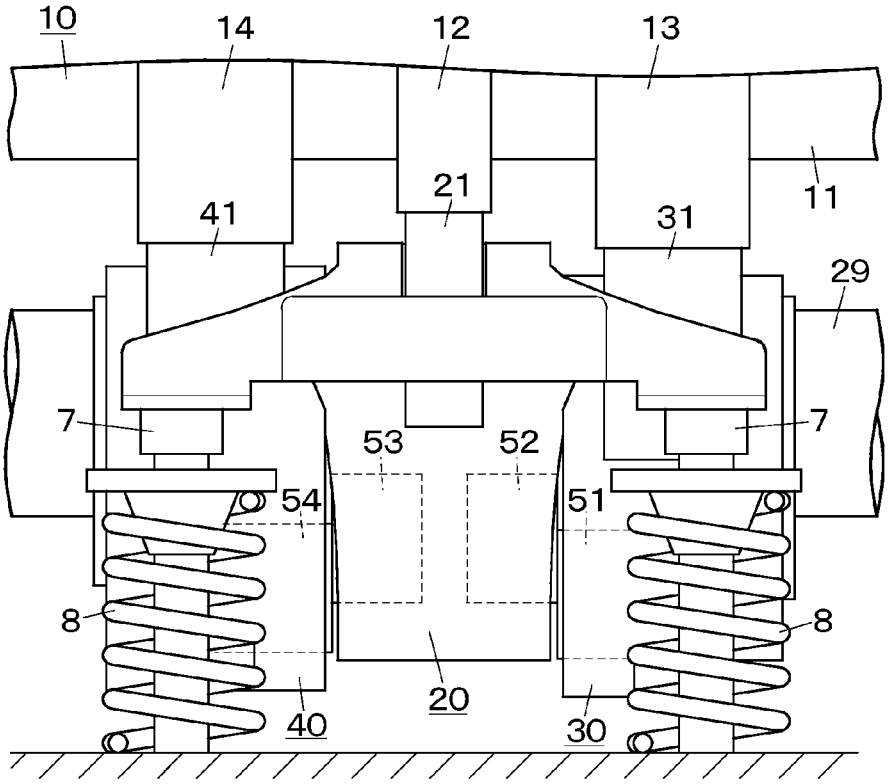
FIG. 5B is a front view thereof.

As shown in FIGS. 5A and 5B, when in the low lift state, the non-coupling hydraulic mechanism 61 increases the oil pressure in the pin hole 25 of the main arm 20 (turns ON), and the coupling hydraulic mechanism 66 reduces the oil pressure in the pin hole 45 of the second sub arm 40 (turns OFF). The oil pressure in the pin hole 25 of the main arm 20 thus presses via the first interposed pin 52 the first coupling pin 51 to a position where the first coupling pin 51 is accommodated in the pin hole 35 of the first sub arm 30, and presses via the second interposed pin 53 the second coupling pin 54 to a position where the second coupling pin 54 is accommodated in the pin hole 45 of the second sub arm 40. As shown in FIG. 5B, the main arm 20 thus swings according to the cam profile of the low lift cam 12 to drive the valves 7, 7, the first sub arm 30 swings and idles according to the cam profile of the medium lift cam 13, and the second sub arm 40 swings and idles according to the cam profile of the high lift cam 14.

[2] In the Medium Lift State (First Coupled State)

Figure 6A:
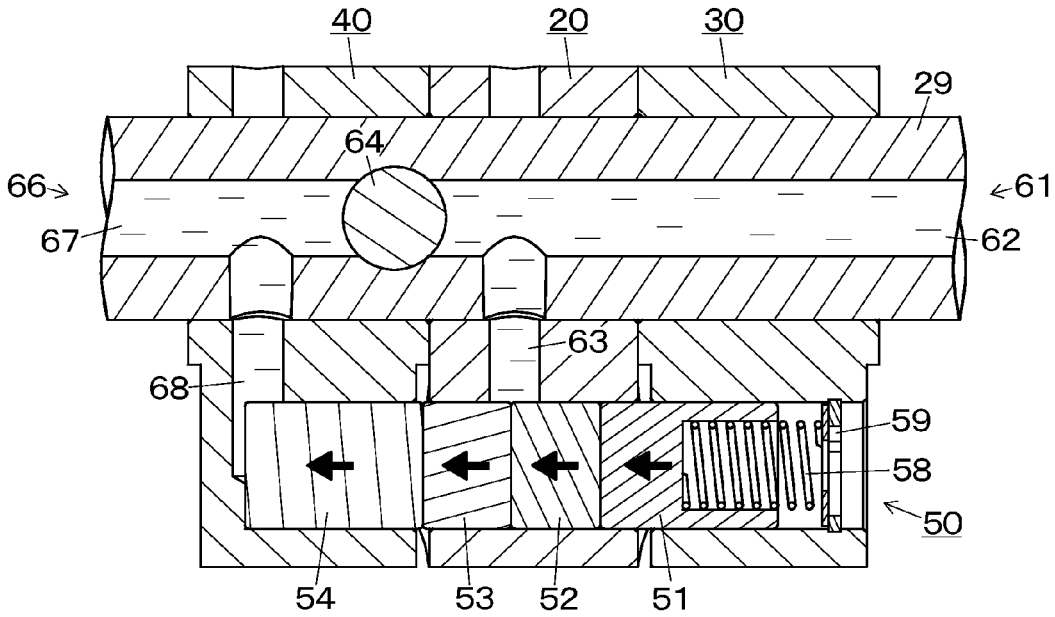
FIG. 6A is a planar sectional view showing the variable valve mechanism of the embodiment in a medium lift state.
Figure 6B:
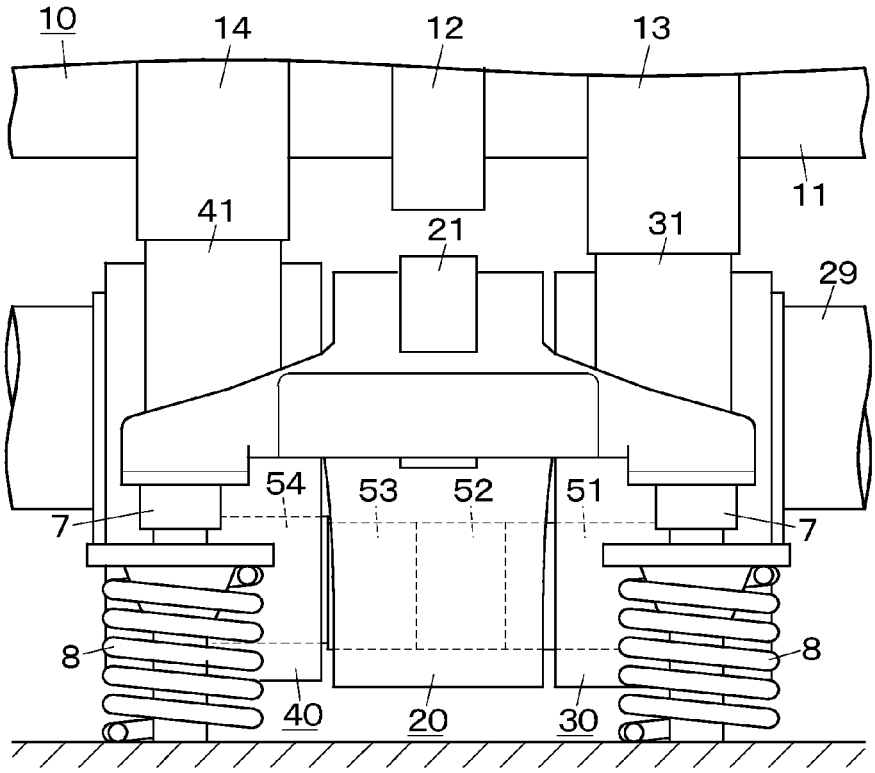
FIG. 6B is a front view thereof.

As shown in FIGS. 6A and 6B, when in the medium lift state, the non-coupling hydraulic mechanism 61 reduces the oil pressure in the pin hole 25 of the main arm 20 (turns OFF), and the coupling hydraulic mechanism 66 reduces the oil pressure in the pin hole 45 of the second sub arm 40 (turns OFF). The restoring force of the return spring 58 thus presses the first coupling pin 51 to a position where the first coupling pin 51 extends across the boundary between the first sub arm 30 and the main arm 20, and presses via the first coupling pin 51, the first interposed pin 52, and the second interposed pin 53 the second coupling pin 54 to a position where the second coupling pin 54 is accommodated in the pin hole 45 of the second sub arm 40. As shown in FIG. 6B, the first sub arm 30 and the main arm 20 thus swing together according to the cam profile of the medium lift cam 13 to drive the valve 7, 7, and the second sub arm 40 swings and idles according to the cam profile of the high lift cam 14.

[3] In the High Lift State (Second Coupled State)

Figure 7A:
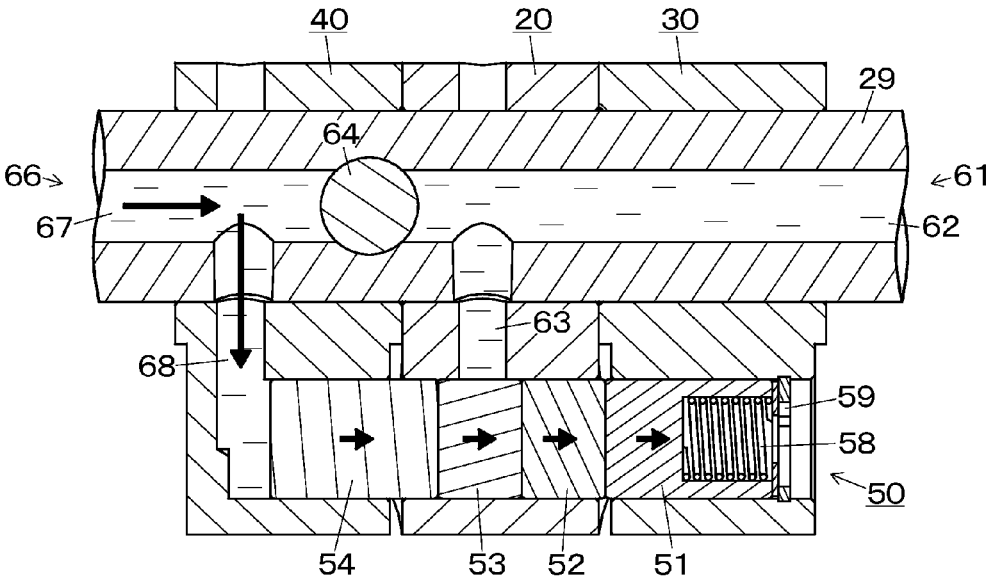
FIG. 7A is a planar sectional view showing the variable valve mechanism of the embodiment in a high lift state.
Figure 7B:
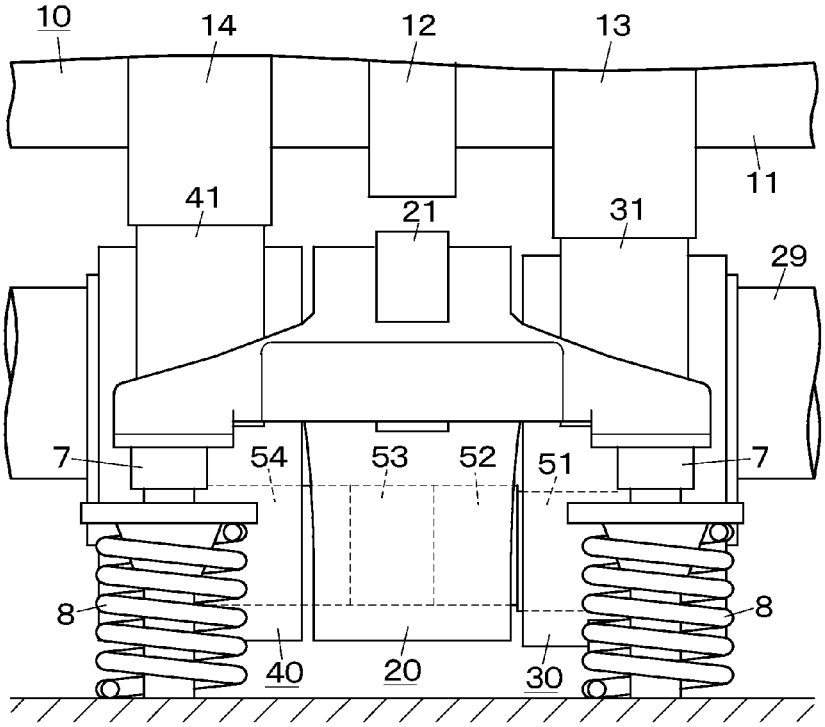
FIG. 7B is a front view thereof.

As shown in FIGS. 7A and 7B, when in the high lift state, the non-coupling hydraulic mechanism 61 reduces the oil pressure in the pin hole 25 of the main arm 20 (turns OFF), and the coupling hydraulic mechanism 66 increases the oil pressure in the pin hole 45 of the second sub arm 40 (turns ON). The oil pressure in the pin hole 45 of the second sub arm 40 thus presses the second coupling pin 54 to a position where the second coupling pin 54 extends across the boundary between the pin hole 45 of the second sub arm 40 and the pin hole 25 of the main arm 20, and presses via the second coupling pin 54, the second interposed pin 53, and the first interposed pin 52 the first coupling pin 51 to a position where the first coupling pin 51 is accommodated in the pin hole 35 of the first sub arm 30. As shown in FIG. 7B, the second sub arm 40 and the main arm 20 thus swing together according to the cam profile of the high lift cam 14 to drive the valve 7, 7, and the first sub arm 30 swings and idles according to the cam profile of the medium lift cam 13.

Accordingly, when switching the lift state from the low lift state to the medium lift state, the first coupling pin 51 and the first interposed pin 52 are shifted from the right side to the left side, and the second interposed pin 53 and the second coupling pin 54 are not shifted. On the contrary, when switching the lift state from the medium lift state to the low lift state, the first coupling pin 51 and the first interposed pin 52 are shifted from the left side to the right side, and the second interposed pin 53 and the second coupling pin 54 are not shifted. When shifting the lift state from the medium lift state to the high lift state, all of the four pins 51, 52, 53, and 54 are shifted from the left side to the right side. On the contrary, when shifting the lift state from the high lift state to the medium lift state, all of the four pins 51, 52, 53, and 54 are shifted from the right side to the left side.

The following advantageous effects [A] to [C] can be obtained according to the present invention.

[A] In the medium lift state, only the first sub arm 30 that is driven by the medium lift cam 13 is coupled to the main arm 20 so as to be non-swingable relative to the main arm 20. In the high lift state, only the second sub arm 40 that is driven by the high lift cam 14 is coupled to the main arm 20 so as to be non-swingable relative to the main arm 20. Accordingly, unlike the conventional example, the medium lift curve C1 does not necessarily constantly exceed the high lift curve C2. This increases design flexibility of the cam profiles of the medium lift cam 13 and the high lift cam 14, thereby facilitating optimal cam profile design.

[B] As shown in FIG. 8, the working angle in the medium lift curve C1 is narrower than that in the high lift curve C2, but the maximum lift amount in the medium lift curve C1 is higher than that in the high lift curve C2. The working angle in the high lift curve C2 is wider than that in the medium lift curve C1, but the maximum lift amount in the high lift curve C2 is lower than that in the medium lift curve C1. Thus, high performance can be ensured in the medium lift state, and fuel efficiency can be improved in the high lift state, whereby overall fuel efficiency can be improved.

[C] The switch device 50 serves both as one switch device that couples and decouples the first sub arm 30 to and from the main arm 20 and as another switch device that couples and decouples the second sub arm 40 to and from the main arm 20. The switch devices can thus be integrated into one, whereby a compact, light variable valve mechanism 9 can be obtained.

The present invention is not limited to the above embodiment, and may be modified as appropriate without departing from the spirit and scope of the invention, as in, e.g., a first modification described below.

[First Modification]

The low lift cam 12 may be eliminated, or the low lift cam 12 may be replaced with a resting cam having a true circular shape in section, so that the low lift state is replaced with a resting state where driving of the valves 7, 7 is suspended.

REFERENCE SIGNS LIST

7 valve
9 variable valve mechanism
11 camshaft
13 medium lift cam (first cam)
14 high lift cam (second com)
20 main arm
30 first sub arm
40 second sub arm
50 switch device
51 first coupling pin
52 first interposed pin
53 second interposed pin
54 second coupling pin
58 return spring
66 non-coupling hydraulic mechanism
C1 coupling hydraulic mechanism
C1 medium lift curve (first lift curve)
C2 high lift curve (second lift curve)

The invention claimed is:

1. A variable valve mechanism of an internal combustion engine, the variable valve mechanism comprising:

a main arm that is capable of swinging and that drives a valve when swinging;

a first sub arm that is provided on one side in a lateral direction of the main arm and that swings when driven by a first cam provided on a camshaft so as to protrude from the camshaft;

a second sub arm that is provided on an other side in the lateral direction of the main arm and that swings when driven by a second cam provided on the camshaft so as to protrude from the camshaft; and a switch device that performs switching between a first coupled state where only the first sub arm of the first and second sub arms is coupled to the main arm so as to be non-swingable relative to the main arm and the main arm to swing according to a cam profile of the first cam, and a second coupled state where only the second sub arm of the first and second sub arms is coupled to the main arm so as to be non-swingable relative to the main arm and the main arm to swing according to a cam profile of the second cam, wherein the switch device is configured to perform switching among a non-coupled state where neither the first sub arm nor the second sub arm is coupled to the main arm so as to be non-swingable relative to the main arm, the first coupled state, and the second coupled state, wherein the switch device includes:

a first coupling pin that extends across a boundary between the main arm and the first sub arm when in the first coupled state and that does not extend across the boundary between the main arm and the first sub arm when in the non-coupled state and the second coupled state;

a second coupling pin that extends across a boundary between the main arm and the second sub arm when in the second coupled state and that does not extend across the boundary between the main arm and the second sub arm when in the non-coupled state and the first coupled state;

a first interposed pin that is provided in the main arm so as to contact the first coupling pin;

a second interposed pin that is provided in the main arm so as to contact the second coupling pin;

a non-coupling hydraulic mechanism that is provided in the main arm, and that uses an oil pressure to press the first coupling pin into the first sub arm via the first interposed pin and to press the second coupling pin into the second sub arm via the second interposed pin, when in the non-coupled state;

a return spring that is provided in the first sub arm, and that uses a restoring force to press the first coupling pin to a position where the first coupling pin extends across the boundary between the first sub arm and the main arm and to press the second coupling pin into the second sub arm via the first coupling pin, the first interposed pin, and the second interposed pin, when in the first coupled state; and a coupling hydraulic mechanism that is provided in the second sub arm, and that uses an oil pressure to press the second coupling pin to a position where the second coupling pin extends across the boundary between the second sub arm and the main arm and to press the first coupling pin into the first sub arm via the second coupling pin, the second interposed pin, and the first interposed pin, when in the second coupled state, wherein the non-coupling hydraulic mechanism includes a non-coupling shaft oil passage formed in the rocker shaft, wherein the coupling hydraulic mechanism includes a coupling shaft oil passage formed in the rocker shaft, and wherein the non-coupling shaft oil passage is separated from the coupling shaft oil passage by a partition pin inserted in the rocker shaft.

2. The variable valve mechanism of the internal combustion engine according to claim 1, wherein a first plot of position showing a lift amount of the valve relative to a rotation angle of the camshaft when in the first coupled state of the switch device intersects with a second plot of position showing the lift amount of the valve relative to the rotation angle of the camshaft when in the second coupled state of the switch device.

3. The variable valve mechanism of the internal combustion engine according to claim 2, wherein a working angle in the first plot of position is narrower than a working angle in the second plot of position, and a maximum lift amount in the first plot of position is higher than a maximum lift amount in the second plot of position.

4. The variable valve mechanism of the internal combustion engine according to claim 1, wherein a surface of the first interposed pin is attached to a surface of the second interposed pin.

5. The variable valve mechanism of the internal combustion engine according to claim 1, wherein the non-coupling shaft oil passage contacts a surface of the partition pin, and the coupling shaft oil passage contacts another surface of the partition pin.

6. The variable valve mechanism of the internal combustion engine according to claim 5, wherein, in the rocker shaft, the surface of the partition pin is located opposite to said another surface of the partition pin.

7. The variable valve mechanism of the internal combustion engine according to claim 1, wherein, in the lateral direction of the main arm, the non-coupling shaft oil passage and the coupling shaft oil passage are disposed on opposing sides of the partition pin.

8. The variable valve mechanism of the internal combustion engine according to claim 1, further comprising:

a retainer attached to the first sub arm, wherein the return spring is interposed between the retainer and the first coupling pin.

9. The variable valve mechanism of the internal combustion engine according to claim 1, further comprising:

a non-coupling arm oil passage formed in the main arm to supply the oil pressure in the non-coupling shaft oil passage to a region between the first interposed pin and the second interposed pin.

10. The variable valve mechanism of the internal combustion engine according to claim 9, further comprising:

a coupling arm oil passage formed in the second sub arm to supply the oil pressure in the coupling shaft oil passage to a region of the second sub arm.

* * * * *